United States Patent [19]

Van Riesen

[11] Patent Number: 4,809,409

[45] Date of Patent: Mar. 7, 1989

[54] BELT LOCK FOR SAFETY BELT SYSTEMS

[75] Inventor: Reiner Van Riesen, Elmshorn, Fed. Rep. of Germany

[73] Assignee: Van Riesen & Co., Pinneberg, Fed. Rep. of Germany

[21] Appl. No.: 181,643

[22] Filed: Apr. 14, 1988

[30] Foreign Application Priority Data

May 6, 1987 [DE] Fed. Rep. of Germany ... 8706467[U]

[51] Int. Cl.[4] ..... A44B 11/14

[52] U.S. Cl. ..... 24/635; 24/642; 24/645

[58] Field of Search ..... 24/635, 642, 645, 640, 24/632, 641, 639, 636, 662, 663, 574, 575, 577, 578

[56] References Cited

U.S. PATENT DOCUMENTS

| | | | |
|---|---|---|---|
| 3,585,692 | 6/1971 | Le Mire | 24/635 |
| 3,605,210 | 9/1971 | Lohr | 24/642 |
| 4,317,263 | 3/1982 | Föhl | 24/635 |
| 4,637,102 | 1/1987 | Teder et al. | 24/635 |
| 4,709,949 | 12/1987 | Umezawa et l. | 24/645 |

*Primary Examiner*—Victor N. Sakran

*Attorney, Agent, or Firm*—Balogh, Osann, Kramer, Dvorak, Genova & Traub

[57] ABSTRACT

A belt lock for safety belt systems, more especially a small-size lock, comprising a lock housing with a closure mechanism which contains an ejector, with a release key and with at least one eye for the fastening of a first belt strap end, and at least two further endpieces, held in the working position by the mechanism, for further belt strap ends. The endpieces have respective detent arms which overlie one another and are held in a predetermined plug-in position with respect to one another in the working position, being unlockable by means of the release key co-operating with a metal spring which actuates the ejector. The closure mechanism has mutually opposed resilient counter-detent tongues which receive between them the detent tongues of the endpieces and in that the release key which unlocks the detent tongues is provided on a lateral narrow side of the lock housing. The entire belt lock with the exception of the ejector spring is made of plastics material.

8 Claims, 2 Drawing Sheets

BELT LOCK FOR SAFETY BELT SYSTEMS

BACKGROUND OF THE INVENTION

1. Field of the Invention

The invention relates to a belt lock for safety belt systems, more especially a small-size lock of the type comprising a lock housing with a closure mechanism which contains an ejector, with a release key and with at least one eye for the fastening of a first belt strap end, the housing and the key being made of plastics material, and at least two further endpieces, held in the working position by the mechanism, for further belt strap ends, wherein the endpieces each have a detent arm and the detent arms are held in a predetermined position with respect to one another in the working position and are unlockable by means of the release key along with the collaboration of a metal spring which actuates the ejector.

2. Description of the Prior Art

In the case of the small-size belt locks for safety belt systems, which as a rule are used in the case of belt systems intended for small children in motor vehicles, the entire closure mechanism consists of chromium-plated steel components. Furthermore, the release key is provided in the region of the upper side of the lock housing.

The metal component parts of the closure mechanism necessitate relatively high production costs and lead to a correspondingly increased overall weight of the belt lock, which for a secured small child more especially in the case of fairly long car travel usually becomes a tiresome burden. Since the release key is disposed in the region of the front side of the lock housing, the thumb pressure on the key for the opening of the lock also acts on the stomach of the small child, which is understandably accordingly unpleasant for the child, unless the manual actuation of the lock on opening is so undertaken that the index finger is positioned as an abutment behind the lock housing and the key is then pressed with the thumb, which is, however, complicated.

SUMMARY OF THE INVENTION

It is accordingly an object of the invention to provide an improved belt lock of the type indicated above which, whilst retaining its compact type of construction and its mechanical strength, is cheaper to produce, lighter in weight and more suitable to operate.

This object is achieved in accordance with the invention in that the entire belt lock with the exception of the ejector spring is made of plastics material, in that the detent arms of the endpieces are designed as detent tongues which overlie one another in the plug-in position and engage thus into the locking mechanism, in that the locking mechanism has mutually opposed resilient counter-detent tongues which receive between then the detent tongues of the endpieces and in that the release key which unlocks the detent tongues of the endpieces is provided on one lateral narrow side of the lock housing.

In a preferred embodiment of the invention, the detent tonque of each endpiece has a detent nose which protrudes outwardly transversely to its longitudinal extent and which can be brought into engagement with a stop shoulder of the corresponding counter-detent tongue of the closure mechanism. The counter-detent tongues have furthermore in their free end regions inwardly directed end parts and the lateral release key is provided with an expansion element, co-operating with the said end parts, to spread apart the counter-detent tongues for the purpose of unlocking. In accordance with a further preferred feature, the lock housing is provided on its other lateral narrow side, which lies opposite the release key, with a gripping depression.

Such a belt lock is, whilst retaining its compactness and its mechanical strength, considerably lighter in weight compared to those of the prior art and can be produced with considerably less cost, since with the exception of the ejector spring all the other components are of plastics material. Also the opening of the belt lock is faster and more comfortable for a child, since the opening pressure is now applied in a direction parallel to the surface extent of the lock. Furthermore, it is advantageous that the belt strap endpieces which co-operate non-interchangeably with one another do not negatively influence the compactness of the belt lock, since the detent arms of these endpieces are designed so as to be insertable into the lock housing.

BRIEF DESCRIPTION OF THE DRAWINGS

Further objects and advantages of the invention will become apparent from the following detailed description taken in conjunction with the accompanying drawings which illustrate a preferred embodiment thereof.

In the Drawings.

DETAILED DESCRIPTION OF THE PREFERRED EMBODIMENT

Figure 1:
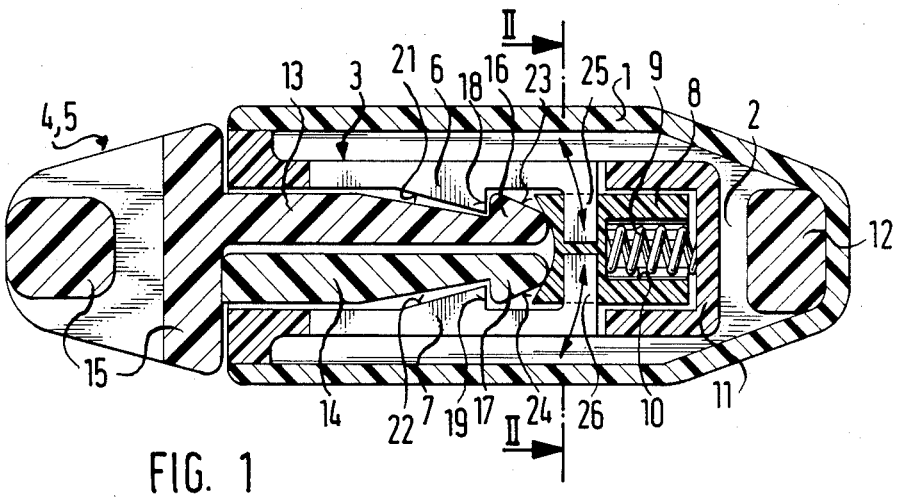
FIG. 1 shows a longitudinal section through the exemplified embodiment.

Referring first to FIG. 1 the belt lock shown, which is used mainly for safety belt systems in motor vehicles, more especially belt systems for small children, comprises a lock housing 1 made of plastics material, which has in the conventional way an eye 2 for the fastening of a first belt strap end, a closure mechanism designated generally by 3 and two further belt strap endpieces 4 and 5 for further belt strap ends, which are fastened thereto in known manner. Since these locks are used predominantly for belt systems for small children, these locks have a small overall size. The closure mechanism 3 constructed in accordance with the push-in principle comprises an upper counter-detent tongue 6, a lower counter-detent tongue 7, an ejector 8 and an ejector spring 9, which is supported on the one hand in a blind hole 10 of the ejector and on the other hand against a wall part 11 of the mechanism 3. For the formation of the fastening eye 2, the frame of the mechanism 3 has a transverse web 12, to which the said first belt strap end is fastened in a manner known per se.

The two belt strap endpieces 4,5 have respective detent arms 13 and 14, which as shown in FIG. 1 overlie and engage one another into the closure mechanism 3 and have at their outer ends eye parts 15 known per se with which the aforesaid further belt strap ends are fastened in a manner known per se. The detent arms 13 and 14 are designed as flat detent tongues which are joined together to overlie one another and are for this purpose designed in a predetermined manner in such a way as to ensure that they can be inserted into the mechanism 3 only in the correct position with respect to one another, whereby it is of course also ensured that the insertion can be effected only in a specific position.

Figure 3:
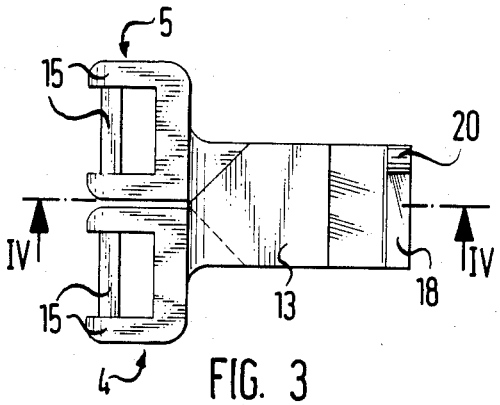
FIG. 3 shows a top view of two belt strap endpieces joined together in the embodiment of FIG. 1.
Figure 4:
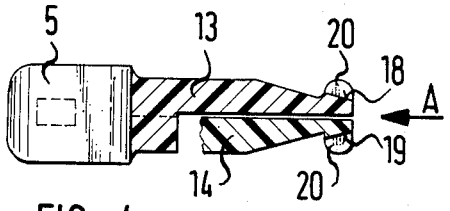
FIG. 4 shows a section along the line IV—IV in FIG. 3.
Figure 5:
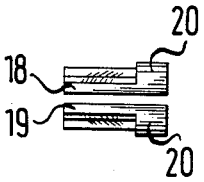
FIG. 5 shows a simplified view in the direction of arrow A in FIG. 4.

As can well be seen from FIGS. 1, 3 and 4, the detent tongues 13 and 14 have at their respective inner ends detent tongues 16,17 which protrude outwardly transversely to their longitudinal extent and which come into abutment with stop shoulders 18,19 of the respective counter-detent tongues 6 and 7. A projection 20 is provided on one lateral end of each of the detent noses, in both projections 20 lying directly opposite one another, whereby it is ensured that the detent tongues 13,14 and thus the belt strap endpieces 4,5 can be inserted only in a specific position into the mechanism 3. It is clear that the counter-detent tongues 6 and 7 of the mechanism 3 allow the free passage of the projections 20 upon the engagement and disengagement of the belt strap endpieces 4,5. As shown by FIG. 1, the ejector 8 butts against the detent noses 17, in order to be able to eject the belt strap endpieces 4,5 as is explained further.

With the exception of the metal spring 9, all the other constituent parts, described in the foregoing, of the belt lock are made of plastics material.

The counter-detent tongues 6 and 7 of the closure mechanism 3 are made resilient, by appropriate choice plastics material, and have oblique sliding surfaces 21 and 22, so that these tongues can be spread apart when the detent noses 16 and 17 of the belt strap endpieces 4,5 slide along thereon. Preferably also the detent noses are provided with oblique sliding surfaces 23 and 24.

Figure 2:
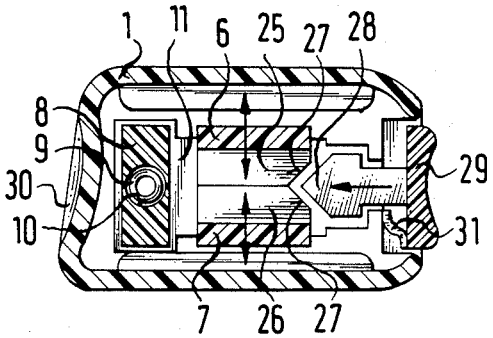
FIG. 2 shows a cross-section along the line II—II in FIG. 1.

In FIG. 1 the entire belt lock is shown in the assembled and locked state. So that the endpieces 4,5 can be unlocked, the counter-detent tongues 6 and 7 are provided with respective inwardly protruding end parts 25,26 which project forwards beyond the detent noses 16 and 17. As shown in FIG. 2 the end parts 25,26 are provided with a lateral bevelling 27, these bevellings acting as cam surfaces and forming between them a V-shaped notch. With these cam surfaces there co-operates an appropriately formed spreading element 28 of a release key 29 of plastics material. It is clear that, when the key 29 is pressed, the counter-detent noses 6 and 7 are pushed apart, so that the belt strap endpieces 4,5 can be ejected. The ejector 8 bears with a concave surface against the ends of the detent arms 13,14 so as to hold them together and prevent their moving apart during ejection. In order to maintain the compactness of the belt lock or even increase it, the ejector 8 is arranged laterally inside the mechanism 3, as shown by FIG. 2. Thus, the ejector 8 lies substantially opposite the release key 29. FIG. 2 likewise shows that the release key 29 is provided on the one lateral narrow side of the lock housing 1, whilst a gripping depression 30 is provided on the opposite narrow lateral side of the lock housing. For the opening the belt lock can now thus be grasped, by the index finger engaging into the gripping trough 30, whilst the thumb of the same hand presses on the release key 29. In this way the lock is opened. The locking of the belt strap end pieces 4,5 is effected by inserting these endpieces with their tongues 13 and 14 into the mechanism 3, whereby the counter-detent tongues 6 and 7 initially move apart and, when the end position of the detent noses 16 and 17 is reached, spring back again, so that the detent noses cooperate with the stop shoulders 18 and 19.

In order to avoid possible rattling of the release key 29 when this is in its initial position, which could disturb the wearer, the key can be provided with a preferably integral spring 31. The spring is supported on the other hand in the interior of the lock, e.g. against the lock housing 1 or against the lock mechanism 3.

It can be seen from FIGS. 1 to 5 in conjunction with the above description that the locking mechanism 3 is compactly constructed and that also the housing 1 is of good rigidity, since the large-surface upper and lower sides of the lock housing 1 have no apertures therein so that in this way a mechanically strong overall lock construction exists.

What is claimed is:

1. A belt lock for a safety belt system comprising:

a lock housing having an aperture for insertion of belt strap endpieces;

means on said lock housing for the fastening of at least one belt strap end;

at least two said belt strap endpieces insertable into said housing, each said endpiece having means for attachment of at least one belt strap end, and having a detent tongue, said tongues being shaped to overlie one another for insertion together into said housing through said aperture;

a locking mechanism within said housing to engage said tongues and retain them in a predetermined locking position relative to one another, said locking mechanism including a pair of mutually opposed resilient counter-detent tongues shaped and arranged to engage and retain between them said overlying tongues;

a release key positioned on a lateral narrow side of said lock housing and actuable to disengage said tongues of said endpieces from said counter-detent tongues and a spring-actuated ejector arranged automatically to push said detent tongues of said endpieces at least partially out of said housing when they are disengaged by said release key.

2. A belt lock as claimed in claim 1 wherein the entire belt lock with the exception of a spring actuating said ejector is made of plastics material.

3. A belt lock as claimed in claim 1, wherein the detent tongue of each endpiece has a detent nose which protrudes outwardly transversely to its longitudinal extent and which engages with a stop shoulder of a corresponding one of said counter-detent tongues of the closure mechanism.

4. A belt lock as claimed in claim 1 wherein the counter-detent tongues have free end regions provided with inwardly directed end parts and wherein said release key has an expansion element co-operating with said end parts to push the counter-detent tongues apart to release said detent tongues of said endpieces.

5. A belt lock as claimed in claim 1 wherein the spring-actuable ejector is provided opposite the release key in the region of an opposite lateral narrow side of the lock housing.

6. A belt lock as claimed in claim 1, wherein a recess is provided in a narrow lateral side of said housing opposite to the side having said release key.

7. A belt lock as claimed in claim 1, wherein said release key is provided with a spring which holds it in a starting position and which is supported in the interior of the lock housing.

8. A belt lock as claimed in claim 1, wherein said ejector is arranged to bear against said detent tongues with a concave surface to prevent them from moving apart during ejection.

* * * * *